United States Patent [19]

Roland et al.

[11] 4,288,225

[45] Sep. 8, 1981

[54] FLUID, COLD-STABLE, TWO-COMPONENT WASHING COMPOSITIONS AND METHOD OF WASHING TEXTILES

[75] Inventors: Wolf-Achim Roland, Hilden; Wolfgang Bechstedt, Langenfeld, both of Fed. Rep. of Germany

[73] Assignee: Henkel Kommanditgesellschaft auf Aktien, Dusseldorf-Holthaasen, Fed. Rep. of Germany

[21] Appl. No.: 174,560

[22] Filed: Aug. 4, 1980

[30] Foreign Application Priority Data

Aug. 18, 1979 [DE] Fed. Rep. of Germany ..... 2933579

[51] Int. Cl.[3] ..... C11D 9/34; C11D 10/04; C11D 10/06; C11D 17/08

[52] U.S. Cl. ..... 8/137; 252/90; 252/92; 252/110; 252/111; 252/117; 252/118; 252/121; 252/122; 252/132; 252/139; 252/153; 252/173; 252/174.16; 252/174.21; 252/DIG. 11; 252/DIG. 14; 252/DIG. 17

[58] Field of Search ..... 252/108, 109, 110, 111, 252/117, 118, 121, 122, 132, 139, 153, 173, 174.16, DIG. 14, 90, 92; 8/137

[56] References Cited

U.S. PATENT DOCUMENTS

| | | | |
|---|---|---|---|
| 3,536,628 | 10/1970 | Lancashire | 252/117 |
| 3,723,328 | 3/1973 | Pelizza | 252/111 |
| 3,850,834 | 11/1974 | Hellsten | 252/117 |
| 3,870,647 | 3/1975 | Travers | 252/118 |
| 3,953,351 | 4/1976 | Keller | 252/132 |
| 3,972,823 | 8/1976 | Howarth | 252/132 |
| 4,082,684 | 4/1978 | Kreischer | 252/109 |
| 4,153,569 | 5/1979 | Brom | 252/109 |

FOREIGN PATENT DOCUMENTS

| | | | |
|---|---|---|---|
| 2609752 | 9/1977 | Fed. Rep. of Germany | 252/121 |
| 1460904 | 12/1966 | France . | |
| 338121 | 4/1931 | United Kingdom | 252/121 |
| 1116966 | 6/1968 | United Kingdom . | |

*Primary Examiner*—Dennis L. Albrecht
*Attorney, Agent, or Firm*—Hammond & Littell, Weissenberger and Muserlian

[57] ABSTRACT

A fluid, two-component washing agent consisting of two components A and B, of which component A is an aqueous dispersion of fatty acids and component B is an alkaline solution, wherein component A is a cold-stable aqueous dispersion consisting essentially of:

(a) from 15% to 35% by weight of substantially unsaturated fatty acids, mainly oleic acid, (b) from 2% to 6% by weight of potassium hydroxide and from 2% to 6% by weight of triethanolamine, where the total amount is so selected that at least 50% by weight of the fatty acids are present as potassium and triethanolamine soaps, (c) from 4% to 10% by weight of an ethoxylated primary alcohol having 5 to 12 oxyethylene units, (d) from 4% to 10% by weight of sodium $C_{10-14}$-alkylbenzenesulfonate, (e) from 0.05% to 1% by weight of at least one optical brightener, (f) from 5% to 15% by weight of at least one $C_{1-3}$-alcohol, and (g) from 35% to 50% by weight of water, and wherein component B is an alkaline solution containing alkaline potassium compounds.

The two components are combined in a ratio of A to B of 2:1 to 1:4 in the wash solution using water with a hardness degree of less than 10° dH (German hardness), where the total content of wash-active components is from 2 to 8 gm/liter and the goods:liquor ratio is 1:4 to 1:8 and the washing process is carried out in a known manner.

12 Claims, No Drawings

FLUID, COLD-STABLE, TWO-COMPONENT WASHING COMPOSITIONS AND METHOD OF WASHING TEXTILES

BACKGROUND OF THE INVENTION

This invention relates to a fluid, two-component washing agent of which one component is a cold-stable aqueous dispersion of substantially unsaturated fatty acids, and the other component is a cold-stable aqueous alkaline dispersion.

Two-component washing agents are preparations consisting of two separately prepared and stored washing agent components that are combined only immediately before or at the beginning of the wash process. The present invention concerns such an agent where both components are liquid concentrates which are stable at low temperatures and where one component is in the form of a liquid concentrate containing fatty acids, soaps of fatty acids, as well as other additional surface-active compounds or tensides, and the other component contains the alkali needed for the formation of soap, and other wash alkalies and builder salts.

A wash process with the use of a two-component washing agent is known from British Pat. No. 338,121. The first component consists of soap-producing fatty acids, such as palmitic acid, stearic acid or oleic acid that are present and mixed with emulsifying agents or solvents, such as sulfated olive oil, hydrocarbons, terpentine and chlorohydrocarbons. The second component contains the alkalies required for the formation of soap such as alkali metal hydroxide, carbonates, bicarbonates, and silicates, and is combined with the first component only in the washing solution. Bleaching components may be added in addition. This process has a number of disadvantages that are important especially in highly automated, commercial laundries.

For example, the fatty acids mentioned are difficult to transport and dose automatically by themselves, while the simultaneous use of solvents from the series of hydrocarbons or chlorohydrocarbons poses considerable problems such as increased danger of fire and explosion or toxicological concerns. Besides, the reaction between the fatty acids, which are not present in a sufficiently fine dispersion in the wash liquor, and the alkali proceeds relatively slowly, especially at washing temperatures below 65° C. Furthermore, the reaction is inhibited or partly prevented by the wash, so that fatty acid deposits may be formed on the wash.

Another process known from French Pat. No. 1,460,904 starts with aqueous fatty acid emulsions suitable for the formation of soap, which combine with the wash alkalies in the washing solution. The fatty acid, which is preferably technical grade oleic acid or a low-melting fatty acid mixture (up to a titer of 45° C.), is emulsified in water with a nonionic emulsifier having a low HLB value agent, such as a monolaurate or a monostearate of polyoxyethylene-sorbitan, with the addition of distilled tall oil, if desired. Alkaline substances are not to be added since these break up the emulsions.

It was found that the cleaning power of these preparations is comparatively low since the emulsifying agents employed do not contribute measureably to the washing power. Furthermore, the stability, especially the stability in cold temperatures, of the emulsions is inadequate since de-emulsification occurs below the freezing point, which de-emulsification is not readily reversible after heating.

Liquids of the above-mentioned type, particularly in the form of highly concentrated preparations, continue to be interesting despite these problems. Highly concentrated substances help to keep the costs for packing, transport and storage low. As liquids they possess the added advantage of being readily transportable and dosable. This offers definite advantages for commercial laundries equipped with respective mixing and storage tanks as well as for household washing machines equipped with storing and dosing devices as are being developed at present. The dosing of detergent in these novel machines is specially adjusted for each wash program, which prevents wrong dosing, which is undesirable and places a strain on the waste water. In order to keep pollution of the sewage discharge at a minimum, the phosphate content of the concentrates should be kept low. In addition, the rate of sudsing should be maintained as low as possible without altering the good washing results.

OBJECTS OF THE INVENTION

An object of the invention, with which the described disadvantages are avoided or the mentioned problems solved, is the production of a washing agent consisting of two components A and B, component A consisting of an aqueous dispersion of soap-producing fatty acids with 12 to 18 carbon atoms and their soaps and component B, of an aqueous solution of alkaline substances capable of complete soap formation together with the fatty acids of component A, as well as of sequestering agents characterized in that component A has the following composition:

(a) from 15% to 35% by weight of a $C_{12-18}$ fatty acid having from 60% to 100% of the fatty acids of oleic acid, (b) from 2% to 6% by weight of potassium hydroxide and from 2% to 6% by weight of triethanolamine, where the total amount is such that from 50% to 95% by weight of the fatty acids are present as a potassium or triethanolamine soap, (c) from 4% to 10% by weight of an ethoxylate of from 5 to 12 ethoxylate units onto a primary alcohol selected from the group consisting of linear $C_{8-14}$-alkanols and $C_{8-14}$-2-methylated-alkanols, (d) from 4% to 10% by weight of a sodium $C_{10-14}$-alkylbenzenesulfonate, (e) from 0.05% to 1% by weight of an alkali metal salt of substituted stilbenesulfonic acid optical brighteners, (f) from 5% to 15% by weight of alcohols selected from the group consisting of $C_{1-3}$-alkanols and mixtures of $C_{1-3}$-alkanols with up to 50% by weight of the mixtures of $C_{1-4}$-alkoxy-$C_{2-3}$-alkanols or $C_{1-4}$-alkoxy-$C_{2-3}$-alkoxy-$C_{2-3}$-alkanols, and (g) from 35% to 50% by weight of water.

Another object of the present invention is the production of a first aqueous dispersion for use in a two-component washing agent composition of which the first component contains an aqueous dispersion of fatty acids and the second component contains alkalies, consisting essentially of:

(a) from 15% to 35% by weight of a $C_{12-18}$ fatty acid having from 60% to 100% of the fatty acids of oleic acid, (b) from 2% to 6% by weight of potassium hydroxide and from 2% to 6% by weight of triethanolamine, where the total amount is such that from 50% to 95% by weight of the fatty acids are present as a potassium or triethanolamine soap, (c) from 4% to 10% by weight of an ethoxylate of from 5 to 12 ethoxylate units onto a primary alcohol selected from the group consisting of linear $C_{8-14}$-alkanols and $C_{8-14}$-2-methylated-alkanols, (d) from 4% to 10% by weight of a sodium $C_{10-14}$-alkylbenzenesulfonate, (e) from 0.05% to 1% by weight of an alkali metal salt of substituted stilbenezulfonic acid optical brighteners, (f) from 5% to 15% by weight of alcohols selected from the group consisting of $C_{1-3}$-alkanols and mixtures of $C_{1-3}$-alkanols with up to 50% by weight of the mixtures of $C_{1-4}$-alkoxy-$C_{2-3}$-alkanols or $C_{1-4}$-alkoxy-$C_{2-3}$-alkoxy-$C_{2-3}$-alkanols, and (g) from 35% to 50% by weight of water.

A yet further object of the present invention is to provide a washing agent consisting of two components, of which one is the above aqueous dispersion and the other is an alkaline solution consisting essentially of:

(h) from 2% to 7% by weight of sodium tripolyphosphate, and from 2% to 7% by weight of potassium tripolyphosphate, where the total amount is from 5% to 12% by weight, (i) from 0.5% to 4% by weight of 1-hydroxyethane-1,1-diphosphonic acid in the form of the sodium or potassium salt, (j) from 10% to 20% by weight of potassium hydroxide and from 0 to 5% by weight of sodium hydroxide, where the total amount of alkali metal hydroxide is from 10% to 20% by weight, (k) from 0.5% to 3.5% by weight of an alkali metal silicate of the composition $Me_2O:SiO_2=1:1$ to 1:3.5, where Me is sodium or potassium, (l) from 0 to 2.5% by weight of a sequestering agent selected from the group consisting of alkali metal salts of polyaminopolycarboxylic acids and alkali metal salts of polyaminopolyphosphonic acids, and (m) from 50% to 70% by weight of water.

A yet further object of the invention is the development of a method of washing textiles using a detergent consisting of two components A and B, component A being the aforesaid aqueous dispersion of fatty acids and component B being the aforesaid alkaline solution, where the weight ratio of component A to component B is from 2:1 to 1:5, in a wash liquor employing water with a hardness of less than 10° dH, where the total content of the wash-active components, wash-alkalies and sequestrants in the wash liquor is from 2 to 8 gm/liter with a wash:liquor ratio of 1:4 to 1:8.

These and other objects of the invention will become more apparent as the description thereof proceeds.

DESCRIPTION OF THE INVENTION

The present invention overcomes the described disadvantages and involves a washing method using a washing agent consisting of two components A and B, component A consisting of an aqueous dispersion of soap-producing fatty acids with 12 to 18 carbon atoms and their soaps, and component B consisting of an aqueous solution of alkaline-reacting compounds capable of complete formation of soap with the fatty acids of component A, as well as sequestering agents, characterized in that component A has the following composition:

(a) from 15% to 35% by weight of fatty acids with 12 to 18 carbon atoms of which 60% to 100% by weight of the fatty acids is oleic acid, (b) from 2% to 6% by weight of potassium hydroxide and from 2% to 6% by weight of triethanolamine, where the total amount is such that at least 50% by weight of the fatty acids are present as potassium or triethanolamine soaps, (c) from 4% to 10% by weight of an ethoxylated primary linear alkanol, or an alkanol with a methyl group in the 2 position, with 8 to 14 carbon atoms and an average of 5 to 12 ethylene glycol ether groups, (d) from 4% to 10% by weight of a sodium alkylbenzene sulfonate with linear alkyl chains having 10 to 14 carbon atoms, (e) from 0.05% to 1% by weight of at least one optical brightener of the class of substituted stilbenesulfonic acids in the form of the Na or K salt, (f) from 5% to 15% by weight of at least one alcohol with 1 or 3 carbon atoms, and (g) from 35% to 50% by weight of water; and component B has the following composition:

(h) from 2% to 7% by weight of sodium tripolyphosphate and from 2% to 7% by weight of potassium tripolyphosphate, where the total amount is from 5% to 12% by weight, (i) from 0.5% to 4% by weight of 1-hydroxy-1,1-diphosphonic acid in the form of the sodium or potassium salt, (j) from 10% to 20% by weight of potassium hydroxide and from 0 to 5% by weight of sodium hydroxide, where the total amount of alkali metal hydroxide is from 10% to 20% by weight, (k) from 0.5% to 3.5% by weight of a sodium and/or potassium silicate of the composition $Me_2O:SiO_2=1:1$ to 1:3.5, (l) 0 to 2.5% by weight of another sequestering agent of the class of the polyaminopolycarboxylic acids and polyaminopolyphosphonic acids, in the form of its alkali metal salt, and (m) from 50% to 70% by weight of water, where component A and component B are combined in a weight ratio of A:B of 2:1 to 1:5 in a wash liquor, using water with a hardness of less than 10° dH (German hardness), so that the total content of the wash active components, wash alkalies and sequestrants in the wash liquor is from 2 to 8 gm/liter with a wash:liquor ratio of 1:4 to 1:8, after which the washing process is carried out in known manner.

More particularly, the present invention relates to an aqueous dispersion for use in a two-component washing agent composition of which the first component contains an aqueous dispersion of fatty acids and the other component contains alkalies, consisting essentially of:

(a) from 15% to 35% by weight of a $C_{12-18}$ fatty acid having from 60% to 100% of the fatty acids of oleic acid, (b) from 2% to 6% by weight of potassium hydroxide and from 2% to 6% by weight of triethanolamine, where the total amount is such that from 50% to 95% by weight of the fatty acids are present as a potassium or triethanolamine soap, (c) from 4% to 10% by weight of an ethoxylate of from 5 to 12 ethoxylate units onto a primary alcohol selected from the group consisting of linear $C_{8-14}$-alkanols and $C_{8-14}$-2-methylated alkanols, (d) from 4% to 10% by weight of a sodium $C_{10-14}$-alkylbenzenesulfonate, (e) from 0.05% to 1% by weight of an alkali metal salt of substituted stilbenesulfonic acid optical brighteners, (f) from 5% to 15% by weight of alcohols selected from the group consisting of $C_{1-3}$-alkanols and mixtures of $C_{1-3}$-alkanols with up to 50% by weight of the mixture of $C_{1-4}$-alkoxy-$C_{2-3}$-alkanols or $C_{1-4}$-alkoxy-$C_{2-3}$-alkoxy-$C_{2-3}$-alkanols, and (g) from 35% to 50% by weight of water.

The fatty acids listed under (a) consist of from 60% to 100%, preferably from 65% to 95%, by weight of the fatty acids of oleic acid. Polyunsaturated fatty acids, such as linoleic acid, may be contained in the fatty acids, in addition to oleic acid, in proportions of from 0 to 25%, preferably 1% to 15%, by weight of the fatty acids. The proportion of saturated fatty acids with 12 to 18 carbon atoms is from 0 to 35%, preferably 2% to 20%, by weight of the fatty acids, with the proportion of stearic acid not to exceed 5% by weight, especially 3% by weight. Suitable fatty acid mixtures have the following composition (in % by weight):

0 to 10%, preferably 0.1% to 5%, lauric acid
0 to 10%, preferably 0.5% to 5%, myristic acid
0 to 15%, preferably 1.0% to 10%, palmitic acid
0 to 5%, preferably 0 to 3%, stearic acid
60% to 100%, preferably 65.0% to 95%, oleic acid
0 to 25%, preferably 1.0% to 15%, linoleic acid.

The amount of fatty acids listed under (a) is preferably from 20% to 30% by weight of the aqueous dispersion.

The portion of potassium hydroxide and triethanolamine mentioned under (b) is preferably 3% to 5% by weight each, so that more than 65% by weight of the fatty acid are preferably present as soap. Preferably, however, an insufficiency of potassium hydroxide and triethanolamine is employed so that complete formation of the soaps of the fatty acids does not occur. 2%, preferably 5% or more, of free fatty acids should be present.

The ethoxylated alcohols listed under (c) are derived from natural or synthetic alcohols, particularly oxoalcohols with 8 to 14, preferably 9 to 12 carbon atoms. The oxoalcohols may be linear or have methyl groups in the 2 position. Also suitable are mixtures of natural fatty alcohols and those obtained by the oxo reaction. The average number of ethylene glycol ether groups is from 5 to 10, preferably 6 to 8. The proportion of the ethoxylated alcohols in the aqueous dispersion amounts to 4% to 10%, preferably 5% to 8%, by weight.

Component (d) consists of a sodium linear alkylbenzenesulfonate having from 10 to 14 carbon atoms in the alkyl, especially sodium dodecylbenzene sulfonate, in amounts of from 4% to 10%, preferably 6% to 8%, by weight of the aqueous dispersion.

The optical brighteners of component (e) are alkali metal salts, preferably Na and K salts, of the substituted stilbenesulfonic acids and are derived from compounds of the formulas:

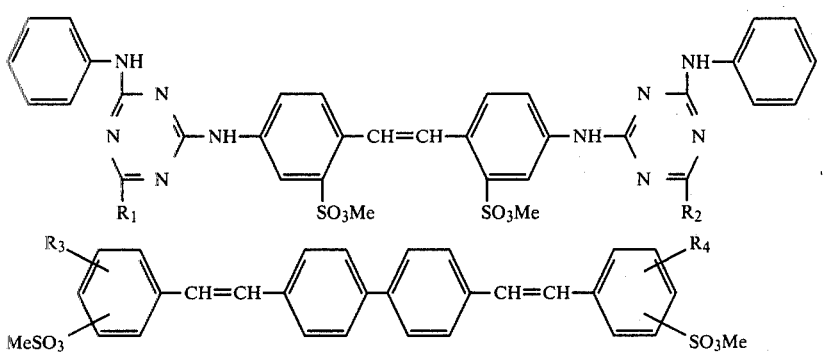

in which the individual symbols Me, $R_1$, $R_2$, $R_3$ and $R_4$ have the following significance:

Me=Na, K $R_1$, $R_2$=—$NHCH_3$, —$NCH_3(CH_2CH_2OH)$, —$N(CH_2CH_2OH)_2$,

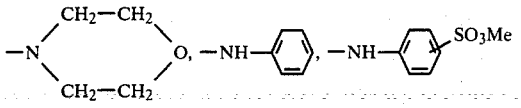

$R_3$, $R_4$=H, —$CH_3$, —Cl, —$OCH_3$, —$COOCH_3$, —CH, —$SO_2NR_5R_6$, —$CONR_5H_6$ with $R_5$ and $R_6$=H or alkyl with 1 to 3 carbon atoms.

Optical brighteners of the formula I, in which $R_1$ and $R_2$ represent morpholino, diethanolamino or anilino radicals, are preferable. The optical brighteners are present in proportions of from 0.05% to 1%, preferably 0.1% to 0.7% by weight of the aqueous dispersion.

Component (f) consists of aliphatic $C_1$-$C_3$-alkanols, such as ethanol, propanol and particularly isopropanol, as well as of the mixtures of the mentioned alkanols. The content of these alkanols in the products is preferably up to 12% by weight. Products with proportions of less than 8% of the mentioned alkanols can also contain hydrotropically active ether alcohols derived from $C_1$-$C_4$-monoalkanols and ethylene glycol or propylene glycol or diethylene glycol. Suitable are methoxyethanol, ethoxyethanol, propoxyethanol, isopropoxyethanol, or butoxyethanol.

The water content of the concentrated aqueous dispersion is from 35% to 50%, preferably 45%, by weight. The shelf-life of the concentrated aqueous dispersions is unlimited in the temperature range between +40° C. and −10° C. They do become pasty after several weeks of storage at a temperature of −10° C., but do not deemulsify even under such extreme conditions and again form liquids upon rewarming that are easy to pour and quite clear.

Other additives that may be present in the aqueous dispersions are biocides, fragrances, dyes, stabilizers, sequestering agents, neutral salts and optical brighteners of other types than those specified, but the proportion of such additives should not exceed a total of 5% by weight and preferably be less than 3% by weight to prevent a negative influence on stability in cold temperatures.

Component B which is combined, before or at the beginning of the washing process, with the abovedescribed aqueous dispersion of component A to form fatty acid soaps is presented as a liquid, easily doseable and particularly stable at low temperatures. Preferably component B has the following composition:

(h) from 2.5% to 6% by weight of sodium tripolyphosphate, and from 2.5% to 6% by weight of potassium tripolyphosphate, where the total amount of tripolyphosphates is from 5% to 12% by weight, preferably from 7% to 10% by weight, (i) 1% to 3% by weight of 1-hydroxyethane-1,1-diphosphonic acid, preferably in the form of the sodium or potassium salt, (j) from 10% to 20% by weight, preferably from 15% to 18% by weight of potassium hydroxide, (k) from 1% to 3% by weight, preferably 1% to 5% by weight, of sodium silicate of the composition $Na_2O$:-$SiO_2$=1:1 to 1:1.5, (l) 0.2% to 2.5% by weight of sodium ethylenediaminetetraacetate, and (m) from 50% to 70% by weight of water.

The mixing ratio of component A with component B according to the composition of the invention is 2:1 to 1:5, preferably 1:2 to 1:4, where the total amount of all wash-active components, wash-alkalies and sequestering agents in the wash liquor is from 2 to 8 gm/liter, preferably 3 to 6 gm/liter, with a wash:liquor ratio of 1:4 to 1:8.

The alkalinity of component B as well as its amount are so selected that the fatty acids are completely converted into soaps, and that there is still an excess of alkali remaining beyond that, so that the pH of the washing solution is 10.5 to 13.5, preferably 11.2 to 13.2. Other compounds with a sequestering effect may be present in addition to the alkalies or polyphosphates and sequestrants, or the ethylenediaminetetraacetate can be substituted by other sequestering agents, such as the Na or K salts of polycarboxylic acids, hydroxypolycarboxylic acids, ether-polycarboxylic acids, aminopolycarboxylic acids, hydroxy-alkanephosphonic acids and aminopolyphosphonic acids. Examples of particularly serviceable compounds are nitrilotriacetic acid, diethylenetriaminepentaacetic acid and 1-aminoethane-1,1-diphosphonic acid.

A liquid solution of wash alkalies that is easily dosed and especially resistant to cold temperatures and was found to be a particularly suitable component B for automated laundries has the following composition:

(i) from 0.5% to 4% by weight of 1-hydroxyethane-1,1-diphosphonic acid in the form of the sodium or potassium salt, (j) from 10% to 20% by weight of potassium hydroxide and from 0 to 5% by weight of sodium hydroxide, where the total amount of alkali metal hydroxide is from 10% to 20% by weight, (k) from 0.5% to 3.5% by weight of an alkali metal silicate of the composition $Me_2O$:$SiO_2$=1:1 to 1:3.5, where Me is sodium or potassium, (l) from 0 to 2.5% by weight of a sequestering agent selected from the group consisting of alkali metal salts of polyaminopolycarboxylic acids and alkali metal salts of polyaminopolyphosphonic acids, and (m) from 50% to 70% by weight of water.

A further subject of the invention is a washing process using two components A and B, according to the above-mentioned compositions, mixing ratios and concentrations. Still other components may be added for these washing processes, such as sodium aluminosilicates capable of cation exchange as described in British Pat. No. 1,473,201 and copending, commonly assigned Ser. No. 956,851, filed Nov. 2, 1978, greying inhibitors, such as cellulose ether and cellulose mixed ethers, enzymes as well as bleaches containing active oxygen or active chlorine, optionally with the addition of bleach activators. As far as the stability of the respective compounds permits, these are also preferably in the form of solutions or dispersions, with an inadequate stability being corrected, if necessary, by enclosing the active substances in a capsule.

The water used for the wash liquor should be softened to a hardness of less than 8° dH (German hardness) (8 mg CaO in 100 ml water), preferably not more than 5° dH (5 mg CaO in 100 ml water). The washing process can be carried out in one or in several stages, that is, it can consist of a prewashing cycle and of a main wash cycle (clear wash cycle). Concentrations and washing temperatures can be different in the washing cycles and amount to 1 to 3 gm/liter at temperatures of 20° C. to 60° C. in the prewashing cycle, and 2 to 6 gm/liter at 60° C. to 95° C. in the main wash cycle.

The detergents used for the method according to the invention are characterized, apart from their good storability at low temperatures, by a high detergency power and low sudsing rate. They, therefore, do not tend to foam over, even under critical conditions, for example, when washing only slightly soiled laundry, like bed or table linen or uniforms which have only been used once. Due to their low phosphate content and their high soap portion in the total detergent, they can be considered as highly ecophile.

The following examples are illustrative of the practice of the invention without being limitative in any respect.

EXAMPLES

The fatty acid mixtures employed in the Examples as component (a) had the composition given in Table 1 (in % by weight).

TABLE I

| Component A | Example 1 | Example 2 | Example 3 |
|---|---|---|---|
| Lauric acid | 1.2 | 0.5 | 0.7 |
| Myristic acid | 3.4 | 1.5 | 1.9 |
| Palmitic acid | 8.6 | 5.7 | 6.3 |
| Stearic acid | 1.8 | 2.1 | 2.0 |
| Oleic acid | 73.0 | 82.0 | 81.3 |
| 9,12-Linoleic acid | 12.0 | 8.2 | 7.8 |

An oxoalcohol with the chain length $C_9$ to $C_{11}$ and 7 ethylene glycol ether groups was used as the ethoxylated alcohol component (c). Component (d) consisted of linear Na dodecylbenzenesulfonate. The sodium salt (Me=Na) of the compound according to Formula I, in which $R_1$ and $R_2$ are morpholino radicals, was used as the optical brighteners component (e). Component (f) consisted of isopropanol. The component "salts" include small amounts of $Na_2SO_4$ and NaCl, which were present as adjuvants of the alkylbenzenesulfonate and the optical brightener. The compositions of Examples 1 to 3 are given in Table 2.

TABLE 2

| Component A | Example 1 | Example 2 | Example 3 |
|---|---|---|---|
| Fatty acid (a) | 25.0 | 30.0 | 26.5 |
| KOH (b) | 3.5 | 4.2 | 4.0 |
| Triethanolamine (b) | 3.5 | 4.0 | 4.5 |
| Ethoxylate (c) | 7.0 | 7.0 | 7.5 |
| Alkylbenzene sulfonate (d) | 7.0 | 6.0 | 6.5 |
| Brightener (e) | 0.4 | 0.4 | 0.4 |
| Isopropanol (f) | 12.0 | 10.5 | 11.5 |
| Salts | 0.4 | 0.4 | 0.4 |
| Water (g) | 41.2 | 37.5 | 38.7 |

For the production of the component A aqueous dispersion, the fatty acid was first mixed with potassium hydroxide in a 30% solution and triethanolamine, ethoxylate (c) and alkylbenzene sulfonate (d) which is present as a 50% solution, after which the optical brightener dissolved in isopropanol was stirred in, and finally the water was added up to the indicated amount.

The concentrates were yellowish, clear to slightly iridescent solutions that were thin liquids at room temperature and which remained clear and homogeneous after three weeks of storage in controlled temperature chambers at −10° C. and +40° C. A repeated temperature change between +40° C. and −10° C. did not cause deemulsification. The concentrates were miscible with water at any ratio.

The following solutions, the constitutions of which are given in Table 3, were used as the alkaline component B (amounts in % by weight).

TABLE 3

| Component B | Example 4 | Example 5 | Example 6 |
|---|---|---|---|
| $Na_5P_3O_{10}$ (h) | 5.0 | 5.0 | 5.0 |
| $K_5P_3O_{10}$ (h) | 5.0 | 5.0 | 5.0 |
| Diphasphonic acid (i) | 1.0 | 2.0 | 3.0 |
| KOH (j) | 18.0 | 18.0 | 18.0 |
| $Na_2O \cdot 3.3\ SiO_2$ (k) | 0.4 | 0.4 | 0.4 |
| Water (m) | 67.8 | 66.8 | 65.8 |

The solutions were also stable in a temperature range of from −10° C. to 30 40° C.

When component A of Examples 1 to 3 and component B of Examples 4 to 6 were combined for the washing process, the following proportions were employed:

SINGLE-SOLUTION PROCESS (90° C.)

5 to 10 gm of component A per kg of dry wash,
12 to 15 gm of component B per kg of dry wash.

TWO-SOLUTION PROCESS

Prewash (60° C.)

3 to 6 gm of component A per kg of dry wash,
12 to 15 gm of component B per kg of dry wash.

Main Wash (Clear Wash) (90° C.)

2 to 5 gm of component A per kg of dry wash,
5 to 8 gm of component B per kg of dry wash.

Perfectly satisfactory washing results were obtained with a solution ratio (kg of dry wash per liter of washing solution) of 1:4 to 1:6, with the use of softened water (3° dH) at 90° C. The amount of foaming was minimal.

After the washing, the laundry was rinsed five times using in the second rinsing solution 0.22 gm/liter of sodium hypochlorite and in the last rinsing solution 0.4 gm/liter of sodium thiosulfate (antichlorine).

The preceding specific embodiments are illustrative of the practice of the invention. It is to be understood, however, that other expedients known to those skilled in the art or disclosed herein, by be employed without departing from the spirit of the invention or the scope of the appended claims.

We claim:

1. A method of washing soiled textiles consisting of the steps of adding a washing agent consisting of two components, A and B, wherein conponent A is an aqueous dispersion of fatty acids consisting essentially of (a) from 15% to 35% by weight of a $C_{12-18}$ fatty acid having from 60% to 100% of the fatty acids of oleic acid, (b) from 2% to 6% by weight of potassium hydroxide and from 2% to 6% by weight of triethanolamine, where the total amount is such that from 50% to 95% by weight of the fatty acids are present as a potassium or triethanolamine soap, (c) from 4% to 10% by weight of an ethoxylate of from 5 to 12 ethoxylate units onto a primary alcohol selected from the group consisting of linear $C_{8-14}$ alkanols and $C_{8-14}$-2-methylated-alkanols, (d) from 4% to 10% by weight of a sodium $C_{10-14}$-alkylbenzenesulfonate, (e) from 0.05% to 1% by weight of an alkali metal salt of substituted stilbenesulfonic acid optical brighteners, (f) from 5% to 15% by weight of alcohols selected from the group consisting of $C_{1-3}$-alkanols and mixtures of $C_{1-3}$-alkanols with up to 50% by weight of the mixture of $C_{1-4}$-alkoxy-$C_{2-3}$-alkanols or $C_{1-4}$-alkoxy-$C_{2-3}$-alkoxy-$C_{2-3}$-alkanols, and (g) from 35% to 50% by weight of water, and component B is an aqueous solution of alkalies consisting essentially of (h) from 2% to 7% by weight of sodium tripolyphosphate and from 2% to 7% by weight of potassium tripolyphosphate, where the total amount is from 5% to 12% by weight, (i) from 0.5% to 4% by weight of 1-hydroxyethane-1,1-diphosphonic acid in the form of the sodium or potassium salt, (j) from 10% to 20% by weight of potassium hydroxide and from 0 to 5% by weight of sodium hydroxide, where the total amount of alkali metal hydroxide is from 10% to 20% by weight, (k) from 0.5% to 3.5% by weight of an alkali metal silicate of the composition $Me_2O:SiO_2 = 1:1$ to 1:3.5 where Me is sodium or potassium, (l) from 0 to 2.5% by weight of a sequestering agent selected from the group consisting of alkali metal salts of polyaminopolycarboxylic acids and alkali metal salts of polyaminopolyphosphonic acids, and (m) from 50% to 70% by weight of water, where the ratio of component A to component B in the combination for washing is from 1:1 to 1:4; and where the washing liquor has a pH of from 9.5 to 14;

to an aqueous wash liquor containing soiled textiles in such amounts that the total amount of all active washing ingredients including wash alkalies is from 2 gm to 8 gm per liter of wash liquor, agitating said textiles in said wash liquor, draining and rinsing said textiles and recovering clean textiles, where the water employed has a German hardness degree of less than 10 °dH and the wash:liquor ratio is from 1:4 to 1:8.

2. The method of claim 1 wherein the fatty acid component (a) consists of 65% to 95% by weight of oleic acid, does not contain more than 3% by weight of stearic acid and is present in an amount of from 20% to 30% by weight of the dispersion.

3. The method of claim 2 wherein the potassium hydroxide and triethanolamine component (b) is present in an amount of from 3% to 5% by weight of the dispersion for the potassium hydroxide and from 3% to 5% by weight of the dispersion for the triethanolamine.

4. The method of claim 1 or 2 or 3 wherein the ethoxylate component (c) is an ethoxylate of from 6 to 8 ethoxylate units onto said primary alcohol having from 9 to 12 carbon atoms and is present in an amount of from 5% to 8% by weight of the dispersion.

5. The method of claim 1 or 2 or 3 wherein said component (d) is sodium dodecylbenzenesulfonate and is present in an amount of from 6% to 8% by weight of the dispersions.

6. The method of claim 1 or 2 or 3 wherein said optical brighteners component (e) is a compound of the formula selected from the group consisting of:

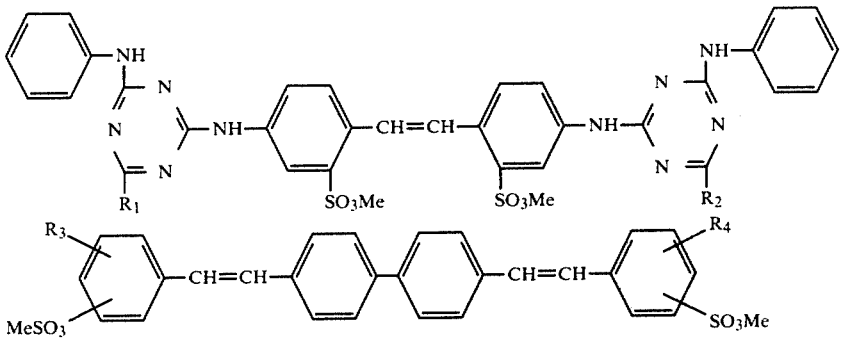

wherein Me is a member selected from the group consisting of sodium and potassium, $R_1$ and $R_2$ are members selected from the group consisting of:

$-NHCH_3$, $-NCH_3(CH_2CH_2OH)$, $-N(CH_2CH_2OH)_2$,

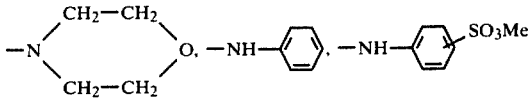

$R_3$ and $R_4$ are members selected from the group consisting of H, $-CH_3$, $-Cl$, $-OCH_3$, $-COOCH_3$, $-CN$, $-SO_2NR_5R_6$, and $-CONR_5R_6$, $R_5$ and $R_6$ are members selected from the group consisting of hydrogen and alkyl having from 1 to 3 carbon atoms.

7. The method of claim 1 or 2 or 3 wherein said alcohol component (f) is isopropanol and is present in an amount of from 8% to 12% by weight of the dispersion.

8. The method of claim 1 or 2 or 3 wherein said water component (g) is present in an amount of from 35% to 45% by weight.

9. The method of claim 1 wherein:

component (h) is present in an amount of from 2.5% to 6% by weight of the aqueous solution of sodium tripolyphosphate and from 2.5% to 6% by weight of the aqueous solution of potassium tripolyphosphate, where the total amount of tripolyphosphates is from 7% to 10% by weight, of the aqueous solution, component (i) is present in an amount of from 1% to 3% by weight of the aqueous solution, component (j) is present in an amount of from 10% to 20% by weight of the aqueous solution of potassium hydroxide, component (k) is present in an amount of from 1% to 3% by weight of the aqueous solution of sodium silicate of the composition $Na_2O:SiO_2=1:2$ to 1:3.5, by weight of the aqueous solution, and component (m) is present in an amount of from 50% to 70% by weight of the aqueous solution.

10. The method of claim 1 wherein the ratio of component A to component B in the combination for washing is from 1:2 to 1:3.

11. The method of claim 1 wherein the total amount of all active washing ingredients including wash alkalies in said wash liquor is from 3 gm to 6 gm per liter of wash liquor.

12. The method of claim 1 wherein the water employed has a German hardness degree of not more than 5°dH.

* * * * *

UNITED STATES PATENT AND TRADEMARK OFFICE

CERTIFICATE OF CORRECTION

PATENT NO. : 4,288,225

DATED : September 8, 1981

INVENTOR(S) : WOLF-ACHIM ROLAND and WOLFGANG BECHSTEDT

It is certified that error appears in the above—identified patent and that said Letters Patent is hereby corrected as shown below:

Preamble page [73]: "Holthaasen" should read -- Holthausen --.

Column 9, line 34: "Diphasphonic" should read -- Diphosphonic --.

Column 9, line 40: "30 40°C" should read -- +40°C --.

Column 10, line 1: "by" should read -- may --.

Column 12, line 38: After "1:3.5" please insert -- component (1) is present in an amount of from 0.2% to 2.5% --.

Signed and Sealed this

Tenth Day of August 1982

[SEAL]

Attest:

GERALD J. MOSSINGHOFF

Attesting Officer

Commissioner of Patents and Trademarks